US006459194B1

(12) United States Patent
Akita

(10) Patent No.: US 6,459,194 B1
(45) Date of Patent: Oct. 1, 2002

(54) CATHODE RAY TUBE

(75) Inventor: Fujio Akita, Aichi (JP)

(73) Assignee: Sony Corporation (JP)

( * ) Notice: Subject to any disclaimer, the term of this patent is extended or adjusted under 35 U.S.C. 154(b) by 176 days.

(21) Appl. No.: 09/588,237

(22) Filed: Jun. 6, 2000

(30) Foreign Application Priority Data

Jun. 7, 1999 (JP) ..... 11-159825
Mar. 31, 2000 (JP) ..... 2000-098881

(51) Int. Cl.[7] ..... H01J 29/07
(52) U.S. Cl. ..... 313/402; 313/407; 313/479
(58) Field of Search ..... 313/407, 406, 313/405, 404, 402, 479, 238, 239; 174/35 MS, 35 R

(56) References Cited

U.S. PATENT DOCUMENTS 4,638,211 A * 1/1987 Fonda ..... 313/407 X
4,728,853 A * 3/1988 Sone et al. ..... 313/407 X
4,827,180 A * 5/1989 Sone et al. ..... 313/407 X
5,103,132 A * 4/1992 Van Der Bolt et al. . 313/407 X
5,834,886 A * 11/1998 Jeong et al. ..... 331/407 X

* cited by examiner

*Primary Examiner*—Ashok Patel
(74) *Attorney, Agent, or Firm*—Ronald P. Kananen, Esq.; Rader, Fishman & Grauer, PLLC

(57) ABSTRACT

A metal part inside of the cathode ray tube, including a first member and a second member which are different in thickness and welded to each other has a welding point encompassed to thereby form a hermetic space between the first and second members. Since the fine powder generated at the time of welding is contained within the hermetic space, its movement due to the vibration or the like is restrained.

4 Claims, 5 Drawing Sheets

CATHODE RAY TUBE

BACKGROUND OF THE INVENTION

1. Field of the Invention

The present invention relates to a cathode ray tube, and, in particular, to a color cathode ray tube having a color selection mechanism or the like.

2. Description of the Related Art

In manufacture of a cathode ray tube, welding is performed to connect a metal member to a metal member.

For example, as shown in FIG. 1, a color selection mechanism 5 which is installed to the inside of a color selection mechanism is assembled in such a way that a metal frame 6 and another metal member, for example, a color selection electrode 61 are welded together.

The color selection electrode 61 is such that a plurality of apertures are provided in a thin metal plate.

Also, a shield member 62 made of a thin metal plate is attached to the frame 6 by welding.

The shield member 62 is attached in order to protect the orbit of an electron beam from deviating due to the influences of the earth's magnetic field or the like as well as to reduce changes in color purity of an image displayed on a cathode ray tube.

Generally, at a time of welding the metal member, fine metal powder sputters to the peripheral portion thereof from the welding spot due to a thermal shock of the welding and adheres to the surface of the metal member.

When the fine power of this kind is in a state capable of moving freely, however, there is a case wherein the fine powder moves inside of the cathode ray tube due to vibration or the like.

For example, it is conceivable that the fine powder moves and adheres to the vicinity of an electron gun.

Since a high voltage is applied to the cathode ray tube when it is in operation, a strong electric field is generated in the vicinity of the electron gun.

When the strong electric field acts on the fine powder, there is a case wherein an instantaneous discharge occurs.

Since the discharge of this kind triggers such phenomena as an occurrence of noise to the image displayed on the cathode ray tube, or the like, it is intrinsically not needed in terms of the operation of the cathode ray tube.

Therefore, in the manufacturing process of the cathode ray tube, it is desirable that the fine powder which has adhered to the metal member be removed and not left inside of the cathode ray tube not to be capable of moving freely.

To this end, there are carried out steps to remove the metal-adhered fine powder by an air blow, suction or degaussing and the like.

However, when welding is performed to the portions to be welded by superimposing two metal members, fine powder adheres to a gap between the metal members.

It is also conceivable that the fine powder which has adhered to the gap moves about inside of the cathode ray tube due to the vibrations or the like.

However, because of the structure it is extremely difficult to completely remove the fine powder adhering to the gap.

Meanwhile, the amount of generated fine powder is influenced by the relations between two metal members, for example, such as differences in thickness, materials and the like of the two metal members.

Generally, the larger is the difference in thickness, the stronger becomes a propensity in which the amount of the generated fine powder becomes large.

In many cases, metal parts used for the cathode ray tube are manufactured by welding metal members different in thickness.

And the amount of the generated fine powder is influenced by welding conditions.

Particularly, two metal members which are in a relationship wherein the amount of the generated fine powder is larger, for example, in the case of welding members having a large difference in thickness are much influenced by the welding conditions in terms of the amount of the generated fine powder.

Generally, when the welding conditions are adjusted so as to reduce the generation of the fine powder, there exists a relationship wherein strength at a welded portion becomes weak.

On the contrary, when the welding conditions are adjusted so as to increase the strength of the welded portion, there exists a relationship wherein the generated amount of the fine power increases.

Consequently, when the welding strength is to be increased, the generated amount of the fine powder increases and when the fine powder is prevented from generating it becomes difficult to sufficiently secure the welding strength.

When electric spot welding is used, the welding conditions are adjusted by the value of a welding current and the value of a voltage of welding electrodes.

However, even when these values are varied, it has been difficult to find optimum conditions, for example, conditions under which the fine powder is hardly generated and high strength is sufficiently secured.

On the other hand, when connection is performed using connection members such as screws or bolts in place of connection by welding, the generation of the fine powder can be restrained.

However, the number of parts increases and operations in the manufacturing steps become cumbersome.

As a result, the manufacturing cost increases.

Also, strength of the connection by screws and bolts is in many cases weaker than by welding.

SUMMARY OF THE INVENTION

In order to solve the problem described above, the present invention provides a cathode ray tube which can prevent the fine powder generated by welding from later appearing due to vibration or the like and which can be easily manufactured at a low cost.

A cathode ray tube according to the present invention is such that a metal part within the cathode ray tube comprises a first member and a second member.

The first and second members may be different in thickness as well as material.

And said first member and second member have welding points at portions where they are superimposed.

Further, the present invention is characterized in that a hermetic space is formed so as to surround the welding points between the first member and second member.

The present invention is used in the case where, for example, said first member is the frame of a color selection mechanism and said second member is an internal magnetic shield.

The hermetic space may have such a constitution wherein said second member is attached to the first member having a recessed portion at a welding portion so as to cover the recessed portion.

Also, the hermetic space may have such a constitution wherein the second member with a recessed portion being formed around a welding spot is attached to the first member.

According to said constitution, the fine powder generated at the time of welding is contained in the hermetic space.

As a result, it is possible to prevent the fine powder from moving inside the cathode ray tube due to vibration or the like.

Moreover, welding which put emphasis on welding strength becomes possible.

DESCRIPTION OF THE PREFERRED EMBODIMENTS

The present invention relates to a cathode ray tube having a metal part within.

The present invention is characterized in that the metal part comprises a first member and second member a hermetic space is formed between the first and second members so as to surround a welding point.

Also, in said cathode ray tube according to the present invention, the first member may be a frame of a color selection mechanism and the second member may be an internal magnetic shield material.

Further, in said cathode ray tube according to the present invention, it may be arranged that a recessed portion is formed in a welded portion of the first member and a thin second member is disposed to cover the recessed portion and welded inside of the recessed portion.

Furthermore, in said cathode ray tube according to the present invention, it may be arranged that the recessed portion is formed in the surroundings of the welding point of the second member and the hermetic space is formed by the recessed portion and the first member.

Figure 2:
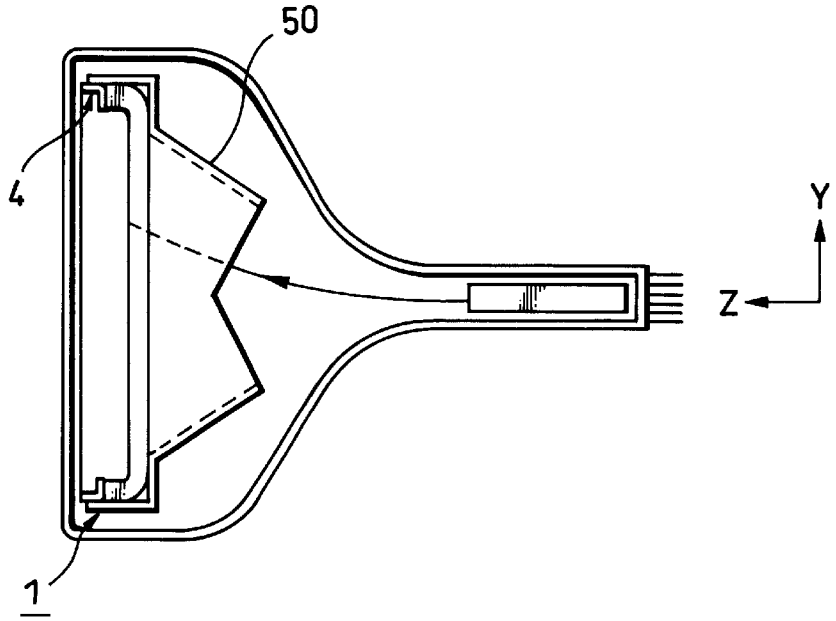
FIG. 2 is a cross-sectional view showing the structure of a cathode ray tube to which the present invention is applied.

FIG. 2 is a cross-sectional view showing the structure of a color cathode ray tube to which the present invention is applied.

Figure 3:
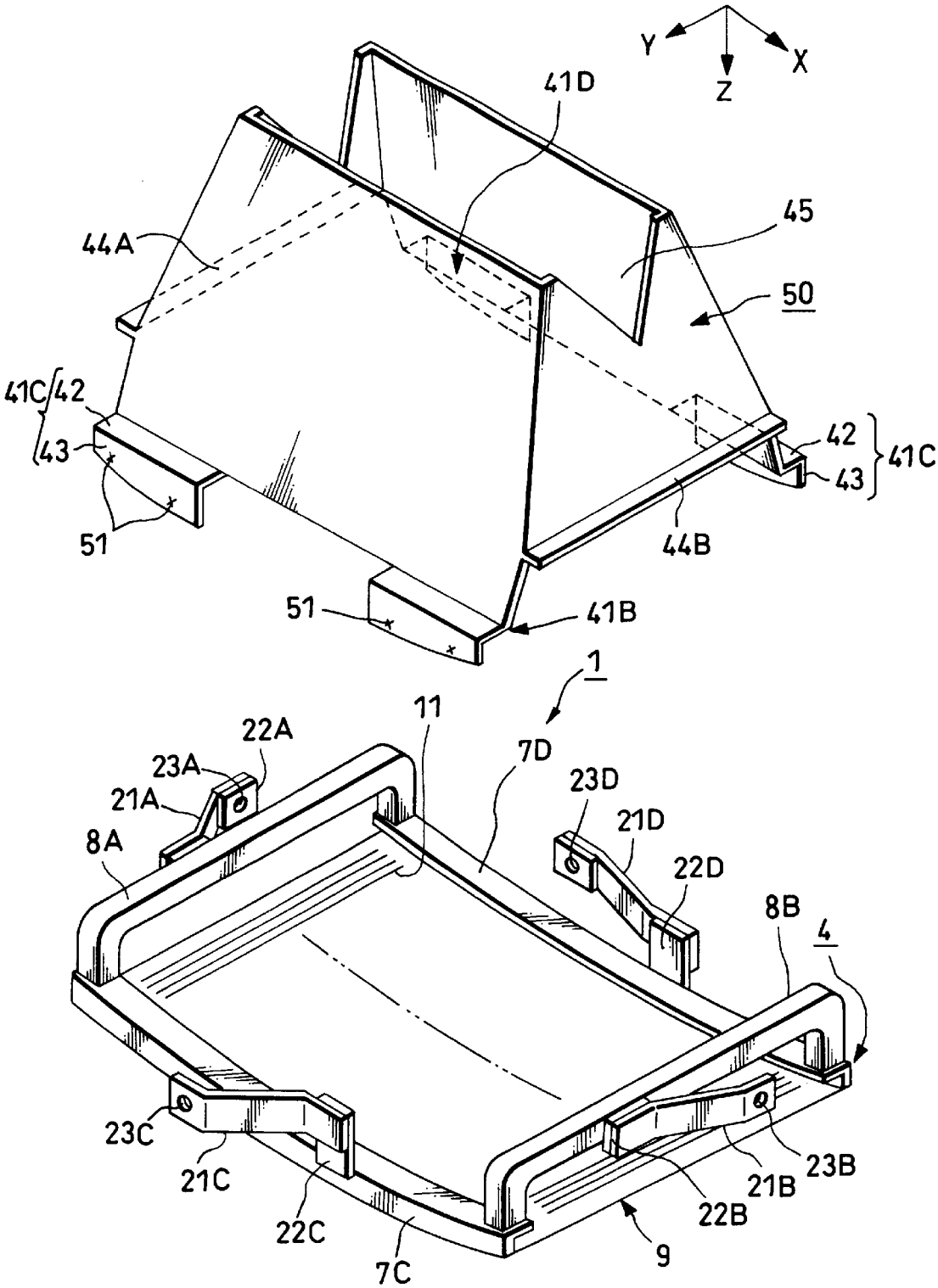
FIG. 3 is a diagram to explain the structures of a color selection mechanism 1 and shield member 50 of the cathode ray tube to which the present invention is applied and a perspective view of the separated color selection mechanism 1 and shield member 50.

FIG. 3 is a perspective view explaining the structures of a color selection mechanism 1 and shield member 50 of the cathode ray tube to which the present invention is applied.

In this color cathode ray tube, a fluorescent screen is formed on the inner surface of a face panel constituting a cathode ray tube body, and a color selection mechanism 1 shown in FIG. 3 is arranged in the face panel portion opposite to the fluorescent screen.

As shown in FIG. 3, the color selection mechanism 1 is formed so that a color selection electrode thin plate 9 in which electrode beam apertures formed between a large number of grid elements 11 extending in the vertical direction, that is, in the Y direction are arranged is suspended on a frame 4.

The frame 4 is constituted by support members 7C and 7D made of steel members or the like which are opposite to each other and have L-shaped sections, and elastic members 8A and 8B made of steel members which stretches between the support members 7C and 7D and are curved to have U shapes.

Spring supports 22A to 22D are fixed on the support members 7C and 7D and the elastic members 8A and 8D, respectively.

Plate-like springs 21A to 21D in which engagement holes 23A to 23D engaged with pins formed on the inner surfaces of the side walls of a face panel are fixed to the spring supports 22A to 22D, respectively.

Meanwhile, as shown in FIG. 2, in order to reduce the influences of an outer magnetic field such as an earth's magnetic field, a shield member 50 is attached to a frame 4.

The shield member 50 is such that one end thereof is fixed to the frame 4 and the like and the other end is extended in the fannel direction in the cathode ray tube.

The shield member 50 is made of a ferromagnetic metal plate having a thickness of, for example, about 0.1 to 0.3 mm.

Further, the shield member 50 is so shaped as to surround electron beams emitted from an electron gun and incident on the color selection mechanism 1 and cover the color selection.

As shown in FIG. 3, its shape is an almost regular pyramid shape and the length of its long side of a bottom-surface opening is set for a length between a pair of elastic members 8A and 8B of the frame 4, and the length of its short side thereof is set for the stretch length between the elastic members 8A and 8B.

Meanwhile, a V-letter shaped notch portion 45 is for adjusting the shield effect of an outside electric field.

Figure 1:
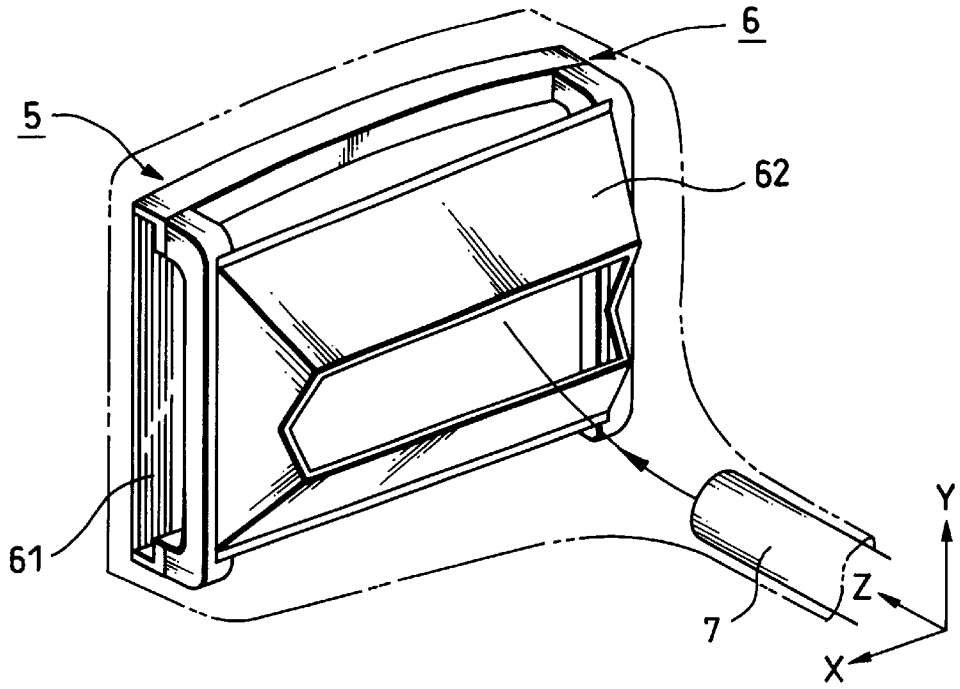
FIG. 1 is a perspective view showing an internal structure of a color cathode ray tube with a color selection mechanism.

Moreover, projections 44A and 44B extending outside to be in contact with the upper surfaces of the elastic members 8A and 8B of the color selection mechanism 1 in FIG. 1 are formed on the short-side portions of the shield member 50.

Attachment portions 41A, 41B, 41C, and 41D attached to the support members 7C and 7D of the color selection mechanism 1 overhang from the long-side portions of the shield member 50.

Each of the attachment portions 41A, 41B, 41C, and 41D is composed of a portion 42 horizontally overhanging from a part of the almost regular pyramid shape and a portion 43 extending further therefrom downward in FIG. 1.

The portion 43 extending downward from each of the attachment portions 41A, 41B, 41C, and 41D has two welding points 51 indicated by marks x.

The welding points 51 are welded to the side surfaces of the support members 7C and 7D to which the spring supports 22C to 22D are attached.

The end edges of the portions 43 extending downward are curved along the support members 7C and 7D.

Next, one embodiment of the present invention will be described below.

In this embodiment, a frame 4 of a color selection mechanism 1 is formed to have a recessed shape near welding points 51.

Figure 4:
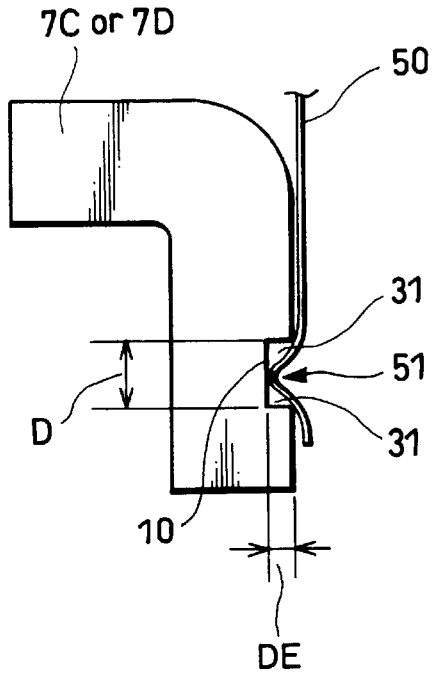
FIG. 4 is an enlarged diagram in the vicinity of a welding point 51 in FIG. 3 according to one embodiment of the present invention.

FIG. 4 shows an enlarged view of a portion near the welding point 51 in FIG. 3 in this embodiment.

As shown in FIG. 4, a support member 7C or 7D of the frame 4 of the color selection mechanism 1 is formed to have a recessed portion 10 serving as a recessed portion near the welding point 51.

On the other hand, the shield member 50 is welded to the bottom of the recessed portion 10 at the welding point 51, and the periphery of the welding point 51 is deformed toward the bottom of the recessed portion 10.

A hermetic space 31 is formed to surround the welding point 51 between the recessed portion 10 of the support member 7C or 7D and the shield member 50.

In the case of a cathode ray tube with the size of about 21 inches, the recessed portion 10 is about 10 to 15 mm in diameter D and its depth DE is about 0.5 mm or less.

Recessed portions 10 may be formed for the respective welding points 51, and a common recessed portion 10 may be formed for the plurality of welding points 51.

In both cases, it is arranged that the hermetic space 31 is formed without making an opening between the shield member 50 and the recessed portion 10.

According to the embodiment described above, fine powder generated by welding can be contained by the hermetic space 31 formed between the frame 4 of the color selection mechanism 1 and the shield member 50.

A method of forming the structure shown in FIG. 4 will be described below with reference to FIG. 5.

Figure 5:
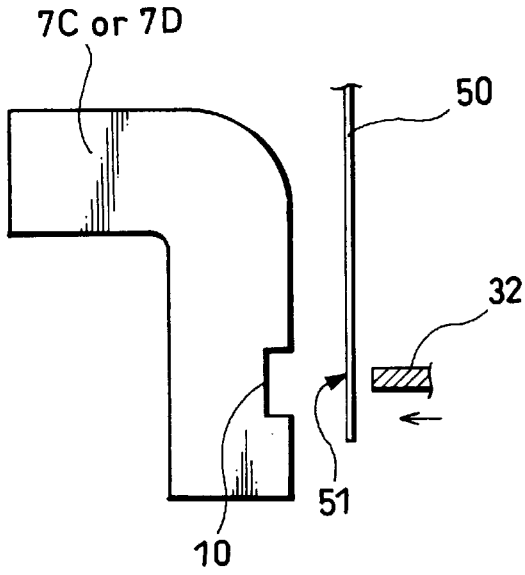
FIG. 5 is a diagram explaining a method of forming the structure illustrated in FIG. 4.

As indicated by an arrow in FIG. 5, the welding point 51 of the shield member 50 is pressed by a welding electrode 32.

This makes the shield member 50 deformed to thereby bring the welding point 51 into contact with the bottom of the recessed portion 10.

When current is passed from a welding electrode 32 in this state, the frame 4 of the color selection mechanism 1, in this case, supporting member 7C or 7D and the shield member 50 are welded together.

Since the recessed portion 10 is covered by the shield member 50, the hermetic space 31 shown in FIG. 4 is formed.

Then, since fine powder generated at the time of welding is contained within the hermetic space 31, the movement of the fine powder is restricted.

Consequently, since welding can be carried out without paying attention to the generation of the fine powder, it is possible to set welding conditions in order to increase the strength of the welding.

Another embodiment of the present invention will be described below.

In this embodiment, a shield member 50 is formed to have a recess-shaped portion near a welding point 51.

Figure 6:
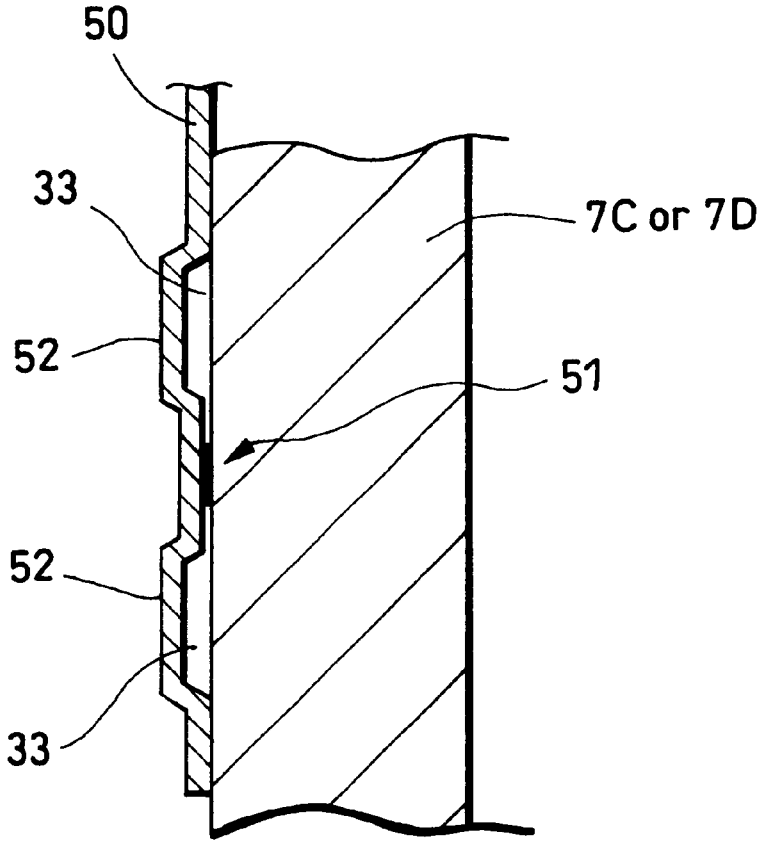
FIG. 6 is an enlarged diagram in the vicinity of a welding point 51 in FIG. 3 according to another embodiment of the present invention.

An enlarged cross-sectional view in the vicinity of the welding point 51 in FIG. 3 in this embodiment is shown in FIG. 6.

As shown in FIG. 6, in the shield member 50, a recessed portion 52 is formed to surround the welding point 51.

Meanwhile, as shown in FIG. 6, it is so arranged that receding amounts become fewer in the vicinity of the shield member 50.

A hermetic space 33 is formed between a support member 7C or 7D and the recessed portion 52 of the shield member 50 to surround the welding point 51.

Figure 7A:
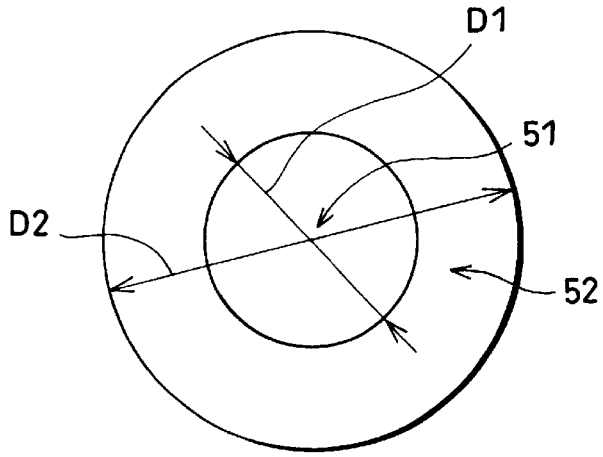
FIG. 7A is a front view of the structure of a recessed portion of the shield member 50 illustrated in FIG. 6.

FIG. 7A is a front view of the recessed portion of the shield member 50.

As shown in FIG. 7A, this recessed portion 52 surrounds the vicinity of the welding point 51 in a dough-nut state.

This makes the hermetic space 33 to be formed around the welding point 51.

Figure 7B:
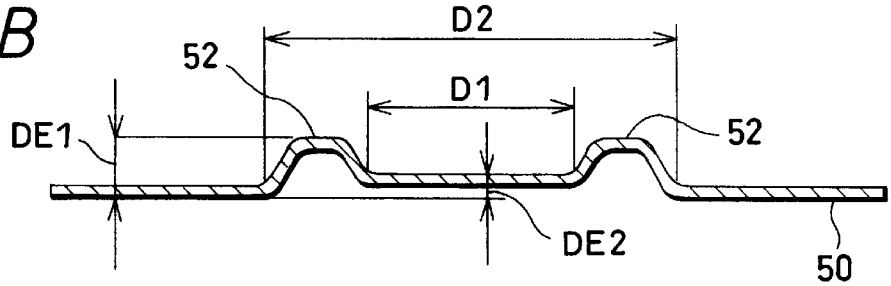
FIG. 7B is a diagram showing a cross section of the recessed portion of the shield member 50 and illustrates a worked deep recessed portion.
Figure 7C:
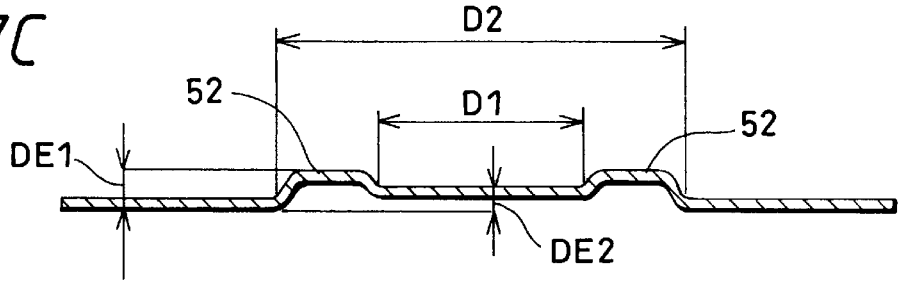
FIG. 7C is a diagram showing the cross section of the recessed portion of the shield member 50 and illustrates a worked shallow recessed portion.

FIGS. 7B and 7C are its cross-sectional views, respectively.

The depth of the recessed portion is appropriately selected according to the generated amount of the fine powder.

For example, when a generated amount of the fine powder is large, a shape such as the one shown in FIG. 5B having a deep recessed portion 52, that is, a large DE1 is recommendable.

Also, when a generated amount of the fine powder is small, a shape such as the one shown in FIG. 5C having a shallow recessed portion, that is, a small DE1 is recommendable.

The procedure of welding is practically as follows.

The shield member 50 is subjected to press work and the like and a recessed portion 52 is formed.

Next, the shield member 50 where the recessed portion 52 is formed is assembled together with the frame 4.

The welding electrode 32 as shown in FIG. 5 is brought in contact with a welding point 51 at the center of the recessed portion 52 and current is passed.

In the case of a cathode ray tube with the size of 21 inches, an inner diameter D1 of the recessed portion 52 is prescribed to be about 5 mm, an outer diameter D2 of the recessed portion 52 is prescribed to be about 10 mm, a height DE1 of the recessed portion is prescribed to be 1.0 mm–1.5 mm and a height DE2 near the welding point 51 is prescribed to be about 0.3 mm.

According to the embodiment above-mentioned, as in the preceding embodiment, since the fine powder generated at the time of welding is contained in the hermetic space 33, the movement of the fine powder is restricted.

Consequently, since welding can be carried out without paying attention to the generation of the fine powder, it is possible to set welding conditions in order to increase the strength of the welding.

Also, since the shield member 50 is a thin metal plate, there is an advantage in that the formation of the recessed portion by press work and the like is easy.

In the above-mentioned embodiments, the present invention has been applied to the welding point between the frame 4 and the shield member 50, but the present invention can be applied to other welding points.

Particularly, the present invention is effective in the cases where materials are different and the difference in thickness is large.

For example, a thin reflection block member may be attached to the frame 4 so as to prevent an electron beam from being reflected by the frame 4.

As the reflection block member, for example, a so-called UBS (upper beam shield) and an IBS (inner beam shield) are known.

They are attached to the support members 7C, 7D or the elastic member 8A, 8B.

The present invention can be applied to the case where the reflection block member is welded to the frame 4.

That is, in the peripheral portion of the frame or the reflection block member, the hermetic space is formed so that the fine powder can be contained.

Meanwhile, the shape of the apertures formed in the color selection electrode of the color selection mechanism may be of a slot-state or a slit-state and the present invention can be applied to either of the cases.

The shield member is not limited to the shape shown in FIG. 1.

The shield member may take other shapes, for example, a shape in which notches are also formed in the long-side portions or a shape in which no notch is formed.

Further, the shield member can employ various constitutions of other shapes, such as a shape in which the position or shape of the attachment portion having the welding point is different from that in FIG. 1, for example, the attachment portion is welded to the elastic member.

A cathode ray tube according to the present invention is not limited to the embodiments described above, and other various modifications can be made without departing from the spirit and scope of the invention.

According to the present invention described above, since the fine powder are sealed in a hermetic space, the free movement of the fine powder into the cathode ray tube is prevented.

Also, by setting welding conditions to increase welding strength, sufficient welding strength can be ensured.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as in the appended claims.

What is claimed is:

1. A cathode ray tube having a color selection mechanism and a magnetic shield member within said tube, wherein:

said color selection mechanism comprises a frame member and a color selection electrode member;

said magnetic shield member has a welding point at which said frame member and said magnetic shield member are superimposed; and, a hermetic space between said frame member and said magnetic shield member surrounds said welding point.

2. A cathode ray tube according to claim 1, wherein said frame member and said magnetic shield member have different thichnesses.

3. A cathode ray tube according to claim 1, wherein a recessed portion is formed in a welding portion of said frame member and said magnetic shield member covers said recessed portion and is welded within said recessed portion.

4. A cathode ray tube according to claim 1, wherein a recessed portion is formed around said welding point of said magnetic shield member and said hermetic space is formed by said recessed portion and said frame member.

* * * * *